US009620310B2

(12) United States Patent
Nguyen et al.

(10) Patent No.: US 9,620,310 B2
(45) Date of Patent: Apr. 11, 2017

(54) ACCESSORY DEVICE HAVING INTEGRALLY FORMED PLUNGER

(71) Applicant: Siemens Industry, Inc., Alpharetta, GA (US)

(72) Inventors: Huy Nguyen, Suwanee, GA (US); Mauricio Rodriguez, Duluth, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 201 days.

(21) Appl. No.: 14/478,255

(22) Filed: Sep. 5, 2014

(65) Prior Publication Data

US 2015/0162147 A1 Jun. 11, 2015

Related U.S. Application Data

(60) Provisional application No. 61/914,448, filed on Dec. 11, 2013.

(51) Int. Cl.
*H01H 13/14* (2006.01)
*H01H 21/22* (2006.01)
*H01H 71/46* (2006.01)

(52) U.S. Cl.
CPC ..... *H01H 21/22* (2013.01); *H01H 71/465* (2013.01); *H01H 2221/044* (2013.01); *H01H 2221/074* (2013.01); *H01H 2221/09* (2013.01)

(58) Field of Classification Search
CPC ..... H01H 2221/016; H01H 2221/044; H01H 2233/004; H01H 2003/466; H01H 2237/004; H01H 3/04; H01H 3/46; H01H 71/52
USPC ..... 200/401, 335, 332, 292, 341; 335/21, 335/172–176
See application file for complete search history.

(56) References Cited

U.S. PATENT DOCUMENTS 4,794,356 A * 12/1988 Yu ..... H01H 71/465 200/331
8,546,713 B2 * 10/2013 Huang ..... G05G 1/04 200/341
2009/0242375 A1 * 10/2009 Kim ..... H04M 1/23 200/5 A

* cited by examiner

*Primary Examiner* — Renee Luebke
*Assistant Examiner* — Ahmed Saeed

(57) ABSTRACT

An accessory device for a circuit breaker. The device includes a housing having a top wall and a hinge portion. The device also includes a plunger arm that extends from the hinge portion to form a cantilever wherein the plunger arm includes a first surface and a sloped surface. The plunger arm is moveable between an initial position wherein the plunger arm does not activate the first and second switches located in the housing and a deflected position wherein the first and sloped surfaces simultaneously contact the first and second switches, respectively, thereby activating the first and second switches. The plunger arm also includes a plunger portion that is oriented transverse to the plunger arm. A mating surface is formed on the plunger portion that mates with a mating surface of a circuit breaker operating mechanism. Further, the housing, hinge portion, plunger arm, and plunger portion are integrally formed.

23 Claims, 3 Drawing Sheets

ACCESSORY DEVICE HAVING INTEGRALLY FORMED PLUNGER

CROSS REFERENCE TO RELATED APPLICATION

This application claims the benefit under 35 U.S.C. §119 (e) of U.S. Provisional Application No. 61/914,448 entitled CLEARING SWITCH INTEGRATED PLUNGER QR-BREAKER ACCESSORIES, filed on Dec. 11, 2013, which is incorporated herein by reference in its entirety and to which this application claims the benefit of priority.

FIELD OF THE INVENTION

The invention relates to accessory devices for circuit breakers, and more particularly, to an accessory device that includes a housing, hinge portion, plunger arm and plunger portion that are integrally formed and wherein the plunger arm includes first and sloped surfaces that simultaneously contact first and second switches located in the housing when the circuit breaker is tripped or turned off thereby activating the first and second switches.

BACKGROUND OF THE INVENTION

A circuit breaker is used to protect an electric circuit from damage caused by a persistent overcurrent condition, short circuit, fault or other anomaly. During normal operation, mating contacts for each phase of the circuit breaker are kept in a closed position to enable current flow through the circuit. When a fault condition is detected, the contacts are automatically opened by an operating mechanism, thus interrupting the circuit and disengaging the circuit from a power supply (i.e., the circuit breaker is tripped).

The circuit breaker includes a housing having at least one accessory pocket configured for receiving a circuit breaker accessory. By way of example, an accessory switch may be located in the first accessory pocket. The accessory switch includes an accessory housing which accommodates an outwardly extending plunger that extends into the circuit breaker housing and engages a cross bar of the operating mechanism. The plunger is displaced by the cross bar when the breaker contacts are opened. This in turn actuates the accessory switch.

The plunger, which is a separate component from the accessory housing, is either attached by a pin or guided in a slot or a hole inside the accessory housing. The housing also accommodates a bias spring that resets the plunger when the plunger is not interacting with the circuit breaker mechanism. Such configurations require multiple parts (plunger, hinge pin, bias spring, and/or retaining hardware) which occupy space in the accessory housing.

However, the available volume within an accessory pocket is limited, thus constraining the size of the accessory housing. It is desirable to reduce the number of parts accommodated within the housing in order to make more space available in the accessory housing so as to provide additional design flexibility. In addition, it is desirable to reduce the number of parts in order to reduce tolerance stackups and assembly errors in order to reduce manufacturing costs.

SUMMARY OF INVENTION

An accessory device for a circuit breaker is disclosed wherein the device includes a housing, hinge portion, plunger arm and plunger portion that are integrally formed. The housing includes a top wall and the hinge portion and holds first and second switches. The plunger arm extends from the hinge portion to form a cantilever wherein the plunger arm includes a first surface and a sloped surface. The plunger arm is moveable between an initial position in which the plunger arm does not activate the first and second switches and a deflected position in which the first and sloped surfaces simultaneously contact the first and second switches, respectively, thereby activating the first and second switches. The plunger arm also includes the plunger portion wherein the plunger portion is oriented transverse to the plunger arm. A second mating surface is formed on the plunger portion that mates with a first mating surface of the circuit breaker operating mechanism. When the circuit breaker is tripped or manually turned off, the second mating surface mates with the first mating surface thereby causing the plunger arm to move. This causes movement of the plunger arm from the initial position to the deflected position in which the first and sloped surfaces simultaneously contact the first and second switches.

The respective features of the present invention may be applied jointly or severally in any combination or subcombination by those skilled in the art.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
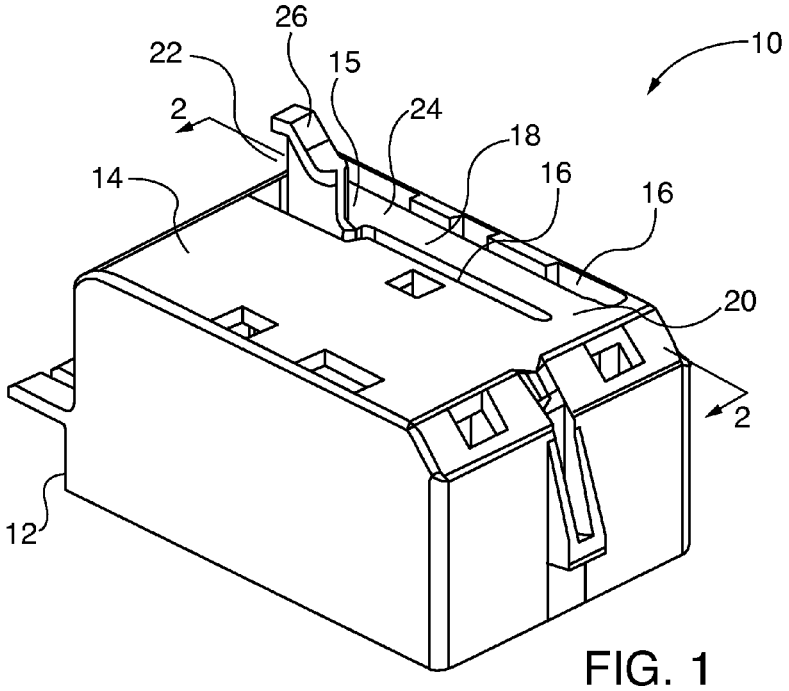
FIG. 1 is a view of an accessory device in accordance with the invention.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Referring to FIG. 1, an accessory device 10 in accordance with the invention is shown. The device 10 includes a housing 12 for holding at least one switch and/or other devices. The housing 12 includes a top wall 14 having spaced apart longitudinal slits 16 that form a plunger arm 18 that is attached to the top wall 14 by a hinge portion 20 to form a cantilever arrangement. An end 15 of the plunger arm 18 includes a plunger portion 22 that extends from an outer surface 24 of the plunger arm 18 and is oriented substantially transverse to an orientation of the plunger arm 18. The plunger portion 22 engages a cross bar element of a circuit breaker as will be described. In an embodiment, an end 26 of the plunger portion 22 has a plunger profile shape 25 that corresponds to a cross bar profile shape 76 (see FIG. 5) to ensure suitable interaction between the plunger portion 22 and the cross bar.

The housing 12, hinge portion 20, plunger arm 18 and plunger portion 22 are formed as a one-piece configuration, i.e. the housing 12, hinge portion 20, plunger arm 18 and plunger portion 22 are integrally or unistructurally formed thereby forming an integrated plunger arrangement. In an embodiment, the housing 12, hinge portion 20, plunger arm 18 and plunger portion 22 are fabricated from a resilient material, such as a thermoplastic material, that enables deflection of the plunger arm 18. Further, the configuration of the integrated plunger arrangement is selected to ensure longevity and reliability when taking into consideration the material selected. In an embodiment, the plunger arm 18 has a rectangular shape. Additionally, the hinge portion 20 may have a cross sectional area that is larger than the cross sectional area of the plunger arm 18 thereby increasing a material web to withstand repeated oscillation of the plunger arm 18 and ensure longevity. Alternatively, the plunger arm 18 may be attached by a fastener or hinge arrangement to the housing 12.

Figure 2:
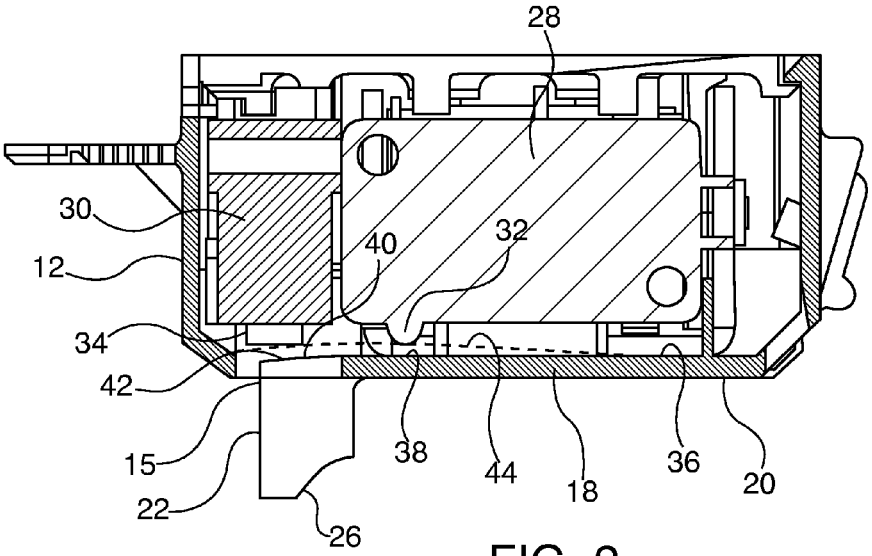
FIG. 2 is an inverted cross sectional view of a housing along view line 2-2 of FIG. 1.

Referring to FIG. 2, an inverted cross sectional view of the housing 12 along view line 2-2 of FIG. 1 is shown. The housing 12 may include first 28 and second 30 switches having first 32 and second 34 switch buttons, respectively. The plunger arm 18 includes a first inner surface 36 having a first contact area 38 that is spaced apart from the first switch button 32. The plunger arm 18 also includes a sloped inner surface 40 having a second contact area 42 that is downwardly sloped toward the end 15 of the plunger arm 18. The width, length, and thickness of the hinge portion 20 and plunger arm 18, along with their material properties, are selected to provide sufficient flexibility to allow the plunger arm 18 to move from an initial position to a deflected position (shown as a dotted line 44 in FIG. 2) and then back to the initial position. Alternatively, the first 38 and second 42 contact areas may be positioned such that they contact the first 32 and second 34 switch buttons but do not exert a sufficient force on the first 32 and second 34 switch buttons for activating the first 32 and second 34 switch buttons.

In the initial position, the first inner surface 36 is in a horizontal orientation and the first 38 and second 42 contact areas are spaced apart from the first 32 and second 34 switch buttons, respectively, or do not exert a sufficient force upon the first 32 and second 34 switch buttons for activating the first 32 and second 34 switch buttons as previously described. In the deflected position (see dotted line 44), the plunger arm 18 is rotated in a clockwise direction about the hinge portion 20 toward the first 32 and second 34 switch buttons such that the plunger arm 18 is in an upwardly sloped orientation. In this position, the first contact area 38 contacts the first switch button 32 with sufficient force to activate the first switch button 32. Due to the orientation of the sloped inner surface 40, the second contact area 42 also contacts the second switch button 34 with sufficient force to activate the second switch 34. Therefore, movement of the plunger arm 18 into the deflected position simultaneously activates the first 32 and second 34 switches.

Figure 3:
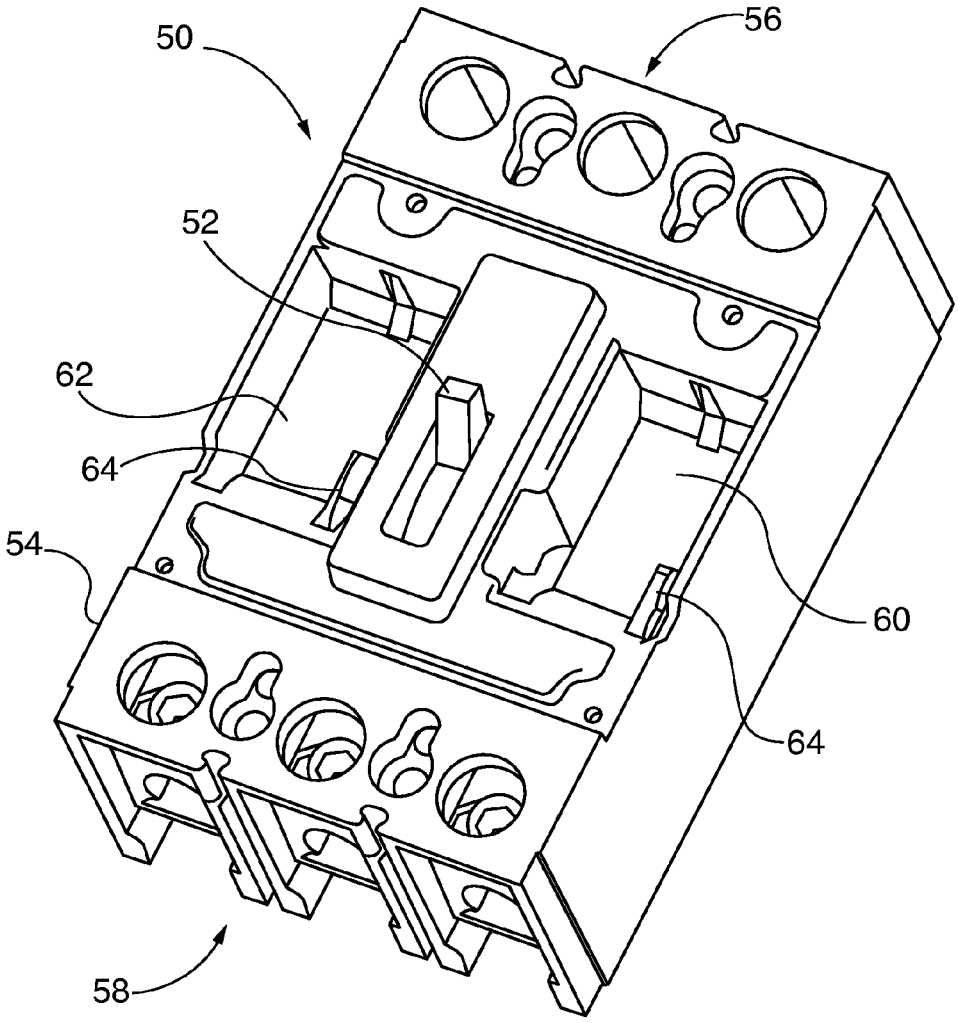
FIG. 3 is a perspective view of an exemplary three-phase circuit breaker.

Referring to FIG. 3, a perspective view of an exemplary three-phase circuit breaker 50 is shown. During normal operation, mating contacts for each phase are kept in a closed position to enable current flow through the circuit. When a fault condition is detected, the contacts are automatically opened by an operating mechanism, thus interrupting the circuit and disengaging the circuit from a power supply (i.e., the circuit breaker is tripped). The circuit breaker 50 also includes a handle 52 that extends from a circuit breaker housing 54 molded from an insulating material. The handle 52 is moveable between on, off and tripped positions which cause the operating mechanism to engage and disengage the contacts for each of the three phases such that a line terminal 56 and load terminal 58 for each phase is electrically connected.

The circuit breaker 50 further includes first 60 and second 62 accessory pockets, each configured for receiving a circuit breaker accessory. By way of example, the device 10 may be located in the first accessory pocket 60. The plunger portion 22 extends through an aperture 64 formed in the first pocket 60 and into the circuit breaker housing 54. The plunger portion 22 then engages a cross bar attached to an operating mechanism.

Figure 4:
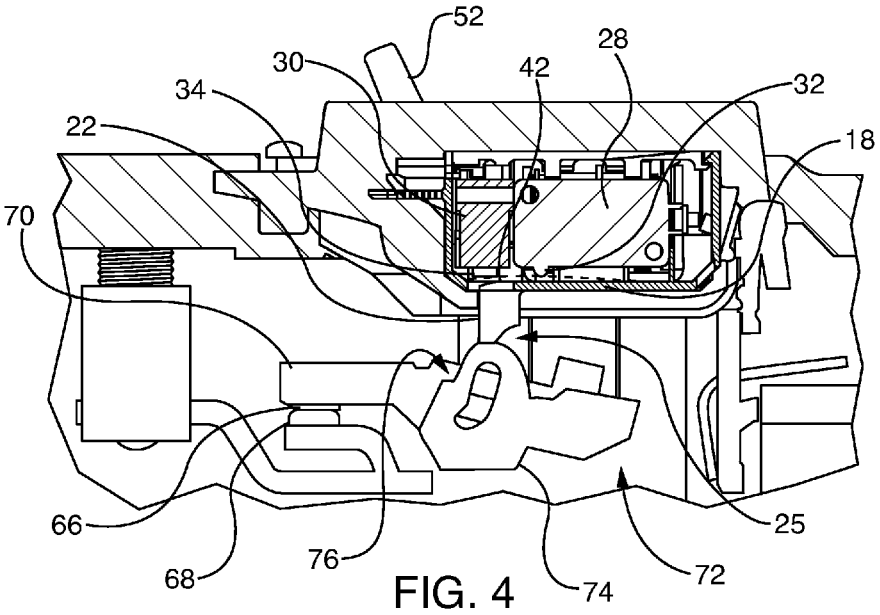
FIG. 4 is a partial cross sectional view are shown of the circuit breaker and the device wherein a plunger portion and a cross bar are not engaged.
Figure 5:
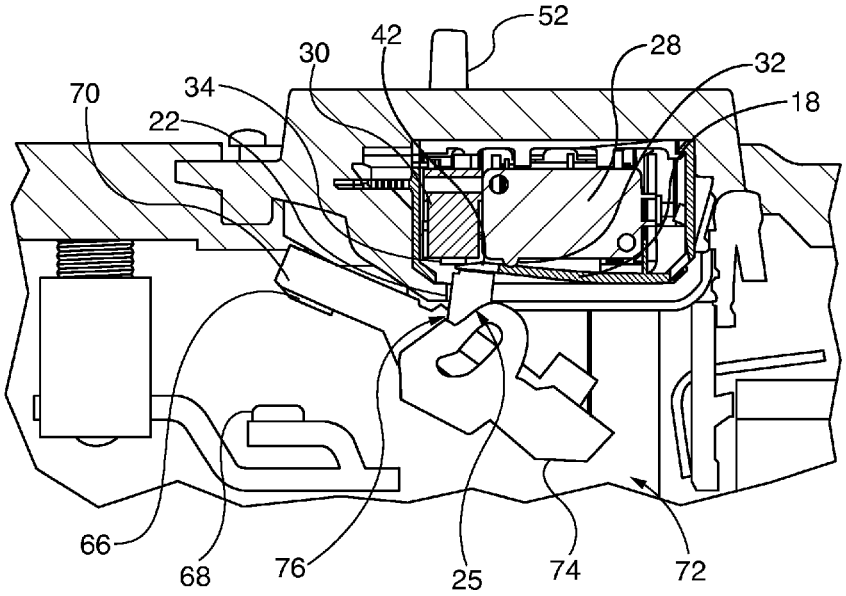
FIG. 5 is a partial cross sectional view are shown of the circuit breaker and the device wherein the plunger portion and the cross bar are engaged.

Referring to FIGS. 4 and 5, partial cross sectional views are shown of the circuit breaker 50 and the device 10. The circuit breaker 50 includes a moveable contact 66 and a stationary 68 contact. The moveable contact 66 is located on a moveable arm 70 that is operatively connected to an operating mechanism 72 having a rotatable cross bar 74 that includes an area having a cross bar shape 76. When the contacts 66, 68 are closed, the cross bar 74 is not engaged with the plunger portion 22. In this state, the plunger arm 18 is in the initial position as previously described. When the circuit breaker 50 is tripped or manually turned off, the moveable arm 70 rotates in clockwise direction, thus opening the contacts 66, 68. This causes the cross bar 74 to rotate until the cross bar profile 76 engages the plunger profile 25 of the plunger portion 22 which in turn causes the plunger arm 18 to move to the deflected position thereby simultaneously activating the first 32 and second 34 switches. By way of example, activation of the first 32 and/or second 34 switches may be used to indicate to personnel that the circuit breaker 50 has tripped or has been turned off. The plunger arm 18 returns to the initial position and the first 32 and second 34 switches return to a deactivated status when the contacts 66, 68 are again closed. In another embodiment, the plunger portion 22 is integrated with the cross bar 74 rather than being integrated with the plunger arm 18. In this embodiment, an end mating portion 23 (see FIG. 2) of the plunger portion 22 contacts the end 15 of the plunger arm 18 when the cross bar 74 rotates to move the plunger arm 18 to the deflected position.

The available volume within an accessory pocket is limited, thus constraining the size of the housing 12. The current invention enables the elimination of multiple components in current device housings such as a hinge pin, bias or return spring and other associated components. This reduces the number of parts in the housing 12 thus reducing tolerance stackups, assembly errors and manufacturing costs and increases an amount of space available in the housing 12.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An accessory device for a circuit breaker, wherein the circuit breaker includes an operating mechanism having a first mating surface, comprising:

a housing having a top wall and a hinge portion wherein the housing holds at least one switch;

a plunger arm extending from the hinge portion to form a cantilever wherein the plunger arm is moveable between an initial position wherein the plunger arm does not activate the at least one switch and a deflected position wherein the plunger arm contacts the at least one switch thereby activating the at least one switch, the plunger arm includes a sloped inner surface having a contact area that is downwardly sloped toward an end of the plunger arm, wherein the contact area is positioned such that the contact area contacts a switch button for activating the switch button; and a second mating surface formed on an end of the plunger arm for mating with the first mating surface wherein the housing, hinge portion and plunger arm are integrally formed.

2. The accessory device according to claim 1, wherein the hinge portion has a cross sectional area that is greater than a cross sectional area of the plunger arm.

3. The accessory device according to claim 1, wherein the housing, hinge portion and plunger arm are fabricated from a resilient material.

4. The accessory device according to claim 1, wherein the housing, plunger arm, hinge portion and plunger arm are fabricated from a thermoplastic material.

5. The accessory device according to claim 1, wherein the accessory device is located in an accessory pocket of the circuit breaker.

6. The accessory device according to claim 1, further including a plunger portion extending from the plunger arm wherein the plunger portion is oriented transverse to the plunger arm and the second mating surface is formed on the plunger portion.

7. The accessory device according to claim 6, wherein the plunger portion extends through an aperture in the circuit breaker.

8. The accessory device according to claim 1, wherein the operating mechanism includes a cross bar and the second mating surface mates with the cross bar.

9. An accessory device for a circuit breaker, wherein the circuit breaker includes an operating mechanism having a first mating surface, comprising:

a housing having a top wall and a hinge portion wherein the housing holds first and second switches;

a plunger arm extending from the hinge portion to form a cantilever wherein the plunger arm includes a first surface and a sloped surface and wherein the plunger arm is moveable between an initial position in which the plunger arm does not activate the first and second switches and a deflected position in which the first and sloped surfaces simultaneously contact the first and second switches, respectively, thereby activating the first and second switches; and a second mating surface formed on an end of the plunger arm for mating with the first mating surface wherein the housing, hinge portion and plunger arm are integrally formed.

10. The accessory device according to claim 9, wherein the hinge portion has a cross sectional area that is greater than the cross sectional area of the plunger arm.

11. The accessory device according to claim 9, wherein the housing, hinge portion and plunger arm are fabricated from a resilient material.

12. The accessory device according to claim 9, wherein the housing, plunger arm, hinge portion and plunger arm are fabricated from a thermoplastic material.

13. The accessory device according to claim 9, wherein the accessory device is located in an accessory pocket of the circuit breaker.

14. The accessory device according to claim 9, further including a plunger portion extending from the plunger arm wherein the plunger portion is oriented transverse to the plunger arm and the second mating surface is formed on the plunger portion.

15. The accessory device according to claim 14, wherein the plunger portion extends through an aperture in the circuit breaker.

16. The accessory device according to claim 9, wherein the operating mechanism includes a cross bar and the second mating surface mates with the cross bar.

17. A method for activating an accessory device for a circuit breaker, wherein the circuit breaker includes an operating mechanism having a first mating surface and wherein the operating mechanism causes the circuit breaker to trip when an electrical fault occurs, comprising:

providing a housing having a top wall and a hinge portion wherein the housing holds first and second switches;

providing a plunger arm extending from the hinge portion to form a cantilever wherein the plunger arm includes a first surface and a sloped surface wherein the housing, hinge portion and plunger arm are integrally formed;

providing a second mating surface formed on an end of the plunger arm;

mating the second mating surface with the first mating surface when the circuit breaker is tripped or turned off thereby causing the plunger arm to move; and moving the plunger arm from an initial position in which the plunger arm does not activate the first and second switches to a deflected position in which the first and sloped surfaces simultaneously contact the first and second switches, respectively, thereby activating the first and second switches.

18. The method according to claim 17, wherein the hinge portion has a cross sectional area that is greater than the cross sectional area of the plunger arm.

19. The method according to claim 17, wherein the housing, hinge portion and plunger arm are fabricated from a resilient material.

20. The method according to claim 17, wherein the accessory device is located in an accessory pocket of the circuit breaker.

21. The method according to claim 17, further including providing a plunger portion extending from the plunger arm wherein the plunger portion is oriented transverse to the plunger arm and the second mating surface is formed on the plunger portion.

22. The method according to claim 21, further including providing an aperture in the circuit breaker wherein the plunger portion extends through the aperture.

23. The method according to claim 17, wherein the operating mechanism includes a cross bar and the second mating surface mates with the cross bar.

* * * * *